United States Patent [19]

Baranyi et al.

[11] Patent Number: 4,952,472

[45] Date of Patent: Aug. 28, 1990

[54] INDIGOID PHOTOCONDUCTOR IMAGING MEMBERS

[75] Inventors: Giuseppa Baranyi; Ah-Mee Hor, both of Mississauga; Rafik O. Loutfy, Willowdale, all of Canada

[73] Assignee: Xerox Corporation, Stamford, Conn.

[21] Appl. No.: 214,248

[22] Filed: Jul. 1, 1988

[51] Int. Cl.[5] ..... G03G 5/082

[52] U.S. Cl. ..... 430/59; 430/77; 430/128; 430/135

[58] Field of Search ..... 430/58, 59, 62, 64, 430/65, 69, 128, 135

[56] References Cited

U.S. PATENT DOCUMENTS

| | | | |
|---|---|---|---|
| 3,839,034 | 10/1974 | Weidemann | 96/1.5 |
| 3,850,630 | 11/1974 | Regensburger et al. | 96/1.5 |
| 4,264,694 | 4/1981 | Pu et al. | 430/58 |
| 4,431,722 | 2/1984 | Takei et al. | 430/57 |
| 4,582,772 | 4/1986 | Teuscher et al. | 430/65 |
| 4,606,987 | 8/1986 | Metsaura et al. | 430/59 |
| 4,622,278 | 11/1986 | Kondo et al. | 430/59 |

FOREIGN PATENT DOCUMENTS 54-139540 7/1979 Japan .

*Primary Examiner*—John L. Goodrow
*Attorney, Agent, or Firm*—E. O. Palazzo

[57] ABSTRACT

Disclosed is an improved layered photoresponsive imaging member comprised of a supporting substrate, a vacuum evaporated photogenerator layer comprised of certain fractionaklly sublimed indigoid pigments such as 4,4,7,7'-tetrachlorothioindigo; and an aryl amine hole transport layer comprised of molecules of the following formula:

dispersed in a resinous binder and wherein X is selected from the group consisting of halogen and alkyl.

33 Claims, 3 Drawing Sheets

INDIGOID PHOTOCONDUCTOR IMAGING MEMBERS

BACKGROUND OF THE INVENTION

This invention is generally directed to layered photoresponsive imaging members, and more specifically to photoconductive imaging members having incorporated therein certain indigoid compounds. In one embodiment of the present invention, there is provided organic photoconductive layered imaging members comprised of certain indigoid compounds and aryl amine hole transport layers. Further, in one important embodiment of the present invention, there is provided a photoresponsive imaging member or device comprised of vacuum evaporated fractionally sublimed indigoids selected from 4,4',7,7'-tetrachlorothioindigo and the derivatives thereof; and an aryl amine hole transport layer. The aforementioned photoconductive members possess a number of advantages as indicated herein inclusive of high photosensitivity, low residual potentials, low dark decay characteristics, and stable cycling properties. The photoresponsive imaging members of the present invention can be selected for various electrophotographic imaging and printing processes wherein, for example, latent images are formed thereon followed by development and transfer to a suitable substrate.

Illustrated in U.S. Pat. No. 3,839,034 are organic double layered electrophotographic recording materials consisting of an electroconductive support and a photoconductive double layer of organic indigoid materials which consist of a homogeneous, opaque, charge carrier producing dyestuff layer of the formula as illustrated in the Abstract of the Disclosure, and the formulas of FIGS. 1 to 17, the formulas of FIGS. 2, 3, 7, and 15 being of particular interest; and a transparent top layer of insulating materials with at least one charge transporting compound. Further, as indicated in column 4, lines 1 to 22, as the Formula 7 compound for the imaging member of the '034 patent there can be selected permanent Red Violet MR (Pigment Red 88). Moreover, it is stated in column 4, beginning at around line 30, that the dyestuff layer may be applied by the vapor deposition thereof in a vacuum. Moreover, this patent discloses a number of resinous binders for the charge transport layer including polycarbonate resins, reference column 6. Since the charge carrier dyestuffs selected for the members of this patent are not fractionally sublimed, there remains therein impurities that can adversely affect the characteristics thereof, including photosensitivity, dark decay, and image quality depending on the impurities present, for example. Prior art primarily of background interest include U.S. Pat. Nos. 4,264,694; 4,606,987; and 4,622,278.

Furthermore, in Konishiroku Kokai Japanese No. 54/1395401A1[79/1030] there is disclosed the use of selected indigoids as charge generator layers in conjunction with triphenyl methane charge transport layers. Specifically, a solution coated dispersion of 4,4',7,7'-tetrachlorothioindigo in a polymer binder can be selected as the charge generator layer. Also, in U.S. Pat. No. 3,850,630 there are disclosed imaging members with dichloro substituted thioindigo vacuum coated charge generator layers contiguous with poly(vinyl carbazole) or 2,4,7-trinitro-9-fluorenone charge transport layers.

Additionally, numerous different xerographic photoconductive members are known including, for example, a homogeneous layer of a single material such as vitreous selenium, or a composite layered device containing a dispersion of a photoconductive composition. An example of one type of composite xerographic photoconductive member is described, for example, in U.S. Pat. No. 3,121,006 wherein there is disclosed finely divided particles of a photoconductive inorganic compound dispersed in an electrically insulating organic resin binder. These members contain, for example, coated on a paper backing a binder layer containing particles of zinc oxide uniformly dispersed therein. The binder materials disclosed in this patent comprise a material such as polycarbonate resins, polyester resins, polyamide resins, and the like, which are incapable of transporting for any significant distance injected charge carriers generated by the photoconductive particles. Accordingly, as a result the photoconductive particles must be in a substantially contiguous particle to particle contact throughout the layer for the purpose of permitting charge dissipation required for a cyclic operation.

There are also known photoreceptor materials comprised of inorganic or organic materials wherein the charge carrier generating, and charge carrier transport functions are accomplished by discrete contiguous layers. Additionally, layered photoreceptor materials are disclosed in the prior art which include an overcoating layer of an electrically insulating polymeric material. However, the art of xerography continues to advance and more stringent demands need to be met by the copying apparatus in order to increase performance standards, and to obtain quality images.

Also, there have been disclosed other layered photoresponsive devices including those comprised of separate generating layers, and transport layers as described in U.S. Pat. No. 4,265,990, the disclosure of which is totally incorporated herein by reference. Examples of photogenerating layers disclosed in this patent include trigonal selenium and phthalocyanines, while examples of transport layers include certain diamines as mentioned herein.

Many other patents are in existence describing photoresponsive devices including layered devices containing generating substances, such as U.S. Pat. No. 3,041,167 which discloses an overcoated imaging member containing a conductive substrate, a photoconductive layer, and an overcoating layer of an electrically insulating polymeric material. This member is utilized in an electrophotographic copying system by, for example, initially charging the member with an electrostatic charge of a first polarity, and imagewise exposing to form an electrostatic latent image, which can be subsequently developed to form a visible image.

Furthermore, there are disclosed in U.S. Pat. Nos. 4,232,102 and 4,233,383 photoresponsive imaging members comprised of trigonal selenium doped with sodium carbonate, sodium selenite, and trigonal selenium doped with barium carbonate, and barium selenite, or mixtures thereof. Moreover, there are disclosed in U.S. Pat. No. 3,824,099 certain photosensitive hydroxy squaraine compositions. According to the disclosure of this patent, the squaraine compositions are photosensitive in normal electrostatographic imaging systems.

Also known are photoconductive devices containing therein various squaraine compositions. Thus, for example, there is illustrated in U.S. Pat. No. 4,508,803, the disclosure of which is totally incorporated herein by reference, photoconductive devices containing novel benzyl fluorinated squaraine compositions. Specifically, in one embodiment illustrated in the '803 patent there is described an improved photoresponsive device comprised of a supporting substrate, a hole blocking layer, an optional adhesive interface layer, an inorganic photogenerating layer, a photoconducting composition layer comprised of benzyl fluorinated squaraine compositions, and a hole transport layer. Other representative patents disclosing photoconductive devices with squaraine components therein, or processes for the preparation of squaraines include U.S. Pat. Nos. 4,507,408; 4,552,822; 4,559,286; 4,507,480; 4,524,220; 4,524,219; 4,524,218; 4,525,592; 4,559,286; 4,415,639; 4,471,041; and 4,486,520. The disclosures of each of the aforementioned patents are totally incorporated herein by reference.

Moreover, disclosed in the published literature are composite electrophotographic photosensitive materials with various azo compounds. For example, there is illustrated in Japanese Ricoh Patent Publication No. 6064354, published Apr. 12, 1985, composite photoconductors wherein one of the photoconductor layers contains an azo compound of the formulas as illustrated. Further, there are illustrated in several U.S. patents illustrative layered organic electrophotographic photoconductor elements with azo, bisazo, or related compounds. Examples of these patents include Nos. 4,400,455; 4,551,404; 4,390,608; 4,327,168; 4,299,896; 4,314,015; 4,486,522; 4,486,519; 4,551,404; and Konishiroku Japanese Patent Laid Open Publication No. 60111247.

Although photoconductive imaging members are known, there remains a need for members with other photogenerator layers. Additionally, there continues to be a need for layered photoresponsive imaging members having incorporated therein certain indigoid compounds, which members will enable the generation of acceptable high quality images, and wherein these members can be repeatedly used in a number of imaging cycles without deterioration thereof from the machine environment or surrounding conditions. Moreover, there is a need for improved layered photoresponsive imaging members wherein the indigoid compounds selected for one of the layers in combination with specific aryl amine charge transport compositions are substantially inert to the users of such members. Additionally, there is an important need for layered photoconductors with indigoid compounds, which photoconductors are of high sensitivity, have low dark decay values, low residual potentials, and possess high cyclic stability. Furthermore, there continues to be a need for photoresponsive imaging members which can be positively or negatively charged thus permitting the development of images, including color images, with positively or negatively charged toner compositions. Moreover, there continues to be an important need for disposable imaging members with nontoxic organic pigments. Also, there is a need for disposable imaging members useful in xerographic imaging processes, and xerographic printing systems wherein, for example, light emitting diodes (LED), helium cadmium, or helium-neon lasers can be selected; and wherein these members are particularly sensitive to the visible region of the spectrum, that is from about 400 to about 700 nanometers. Also, there is a need for low cost, high quality imaging members wherein reduced amounts of photosensitive materials can be selected. Additionally, there is a need for imaging members with vacuum evaporated fractionally sublimed indigoid compounds, which compounds are substantially free of undesirable impurities.

SUMMARY OF THE INVENTION

It is therefore an object of the present invention to provide photoresponsive imaging members containing therein certain indigoid compounds.

A further object of the present invention is the provision of improved photoconductive imaging members with high photosensitivity, low residual potentials, low dark decay values, and excellent cyclic stability.

Additionally, in a further object of the present invention there are provided disposable photoconductive imaging members.

Another object of the present invention resides in the provision of organic layered photoconductive imaging members containing therein certain vacuum evaporated fractionally sublimed indigoid compounds free of impurities that may adversely affect imaging characteristics as photogenerating layers and aryl amine hole transport layers.

In yet another specific object of the present invention there are provided negatively charged layered photoresponsive imaging members comprised of certain vacuum evaporated fractionally sublimed indigoid pigment compositions optionally dispersed in a resinous binder, and thereon a hole transport layer comprised of aryl amine molecules.

There are provided in another object of the present invention positively charged layered photoresponsive imaging members with a top vacuum evaporated fractionally sublimed indigoid pigment composition optionally dispersed in a resinous binder, and thereunder a hole transport layer comprised of aryl amine molecules.

Further, in yet another object of the present invention there are provided imaging and printing methods with the improved photoresponsive imaging members illustrated herein.

Also, in a further important object of the present invention there are provided improved imaging members sensitive to light in the visible region of the spectrum, that is, from about 400 to about 700 nanometers.

These and other objects of the present invention are accomplished by the provision of layered photoconductive imaging members containing therein certain indigoid compounds. More specifically, the layered photoconductive imaging members of the present invention are comprised of specific vacuum evaporated fractionally sublimed indigoid compounds, which function as a photogenerating source, and in contact therewith an aryl hole transport layer.

Accordingly, the photoconductive layered imaging members of the present invention in one embodiment are comprised of, for example, a supporting substrate, an aryl amine hole transport layer, and the purified halogenated indigoids encompassed by Formula I. More specifically, preferred indigoids include those wherein X is sulfur, and the halogen is chlorine, such as 4,4',7,7'-tetrachlorothioindigo which is commercially available from BASF as Paliogen Red Violet L4982 (Pigment Red 88).

The indigoid compounds selected for the imaging members of the present invention are represented generally by the formulas of FIGS. 1, 2, and 3, wherein X is oxygen, sulfur, selenium, or NH, and R is independently selected from the group consisting of phenyl, halogen, alkyl, alkoxy, nitro, hydrogen, amine, and cyano. Examples of alyl, and alkoxy groups include those with from about 1 to about 20 carbon atoms such as methyl, methoxy, ethyl, ethoxy, propyl, propoxy, butyl, butoxy, and the like. Halogen includes chlorine, fluorine, bromine, and iodine. Also, in the compounds of FIG. 2 the R substituents may include other aryl groups such as anthryl. Of the aforementioned indigoids, there is preferred the fractionally sublimed Paliogen Red-Violet L4982 (Pigment Red 88) available from BASF, and wherein X is sulfur, and R is chlorine in FIG. 1.

With further respect to the photoconductive imaging members of the present invention, the photogenerating indigoid compounds can be situated between the supporting substrate and the aryl amine hole transport layer; or alternatively, the aryl amine hole transport layer may be situated between the supporting substrate and the layer comprised of the photogenerating indigoid compounds illustrated herein.

In another specific illustrative embodiment, the improved photoconductive imaging member of the present invention is comprised of (1) a supporting substrate; (2) a hole blocking layer; (3) an optional adhesive interface layer; (4) a photogenerating layer comprised of the indigoid compounds of the formulas of FIGS. 1, 2, or 3; and (5) an aryl amine hole transport layer. Therefore, the photoconductive imaging member of the present invention in one important embodiment is comprised of a conductive supporting substrate, a hole blocking siloxane, silane or metal oxide layer in contact therewith, an adhesive layer, a photogenerating layer comprised of fractionally sublimed indigoid compounds represented by FIGS. 1, 2, or 3 overcoated on the adhesive layer, and as a top layer a hole transport layer comprised of certain aryl amines dispersed in a resinous binder.

Various known processes can be selected for the preparation of the photoconductive imaging members of the present invention, the process parameters in the order of coating of the layers being dependent on the member desired. Specifically, for example, in one method the indigoid photogenerating layer is deposited on a supporting substrate by vacuum sublimation, and subsequently the hole transport layer is deposited thereover by solution coating. In another process variant, the layered photoconductive device can be prepared by providing the conductive substrate containing the hole blocking layer and an optional adhesive layer, and applying thereto by solvent coating processes laminating processes, or other methods, the indigoid photogenerating layer, and the aryl amine hole transport layer.

In the preferred embodiment of the present invention, the indigoid compounds represented by the formulas of FIGS. 1, 2, or 3 are purified prior to incorporation in the imaging members by fractional sublimation, which involves subjecting these pigment compounds to a temperature of from about 200° to 450° C., whereby impurities and decomposition products more volatile than the desired components are separated at a temperature zone of below 200° C. There are thus obtained the desired purified indigoid components at a purity of at least about 95 percent at a temperature zone of from about 270° to 300° C. separated from the nonvolatile impurities, which remain at the high temperature (450° C.) zone.

The improved photoconductive imaging members of the present invention can be incorporated into numerous imaging processes and apparatuses inclusive of those well known such as xerographic imaging and printing processes. Specifically, the imaging members of the present invention are useful in xerographic imaging processes wherein the indigoid pigments absorb light of a wavelength of from about 400 nanometers to about 600 nanometers. In these processes, electrostatic latent images are initially formed on the imaging member followed by development, and thereafter transferring the image to a suitable substrate.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Preferred embodiments will now be illustrated with reference to specific photoconductive imaging members containing the indigoid compounds illustrated herein.

Figure 1:
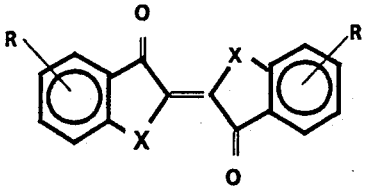
FIGS. 1 to 3 represent the fractionally sublimed photogenerating indigoid compounds selected for the imaging members of the present invention.
Figure 2:
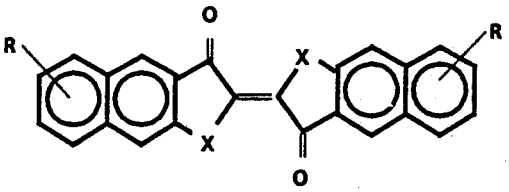
Figure 3:
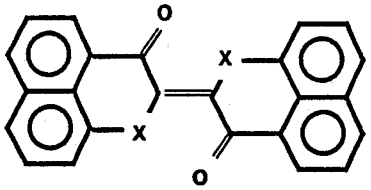
Figure 4:
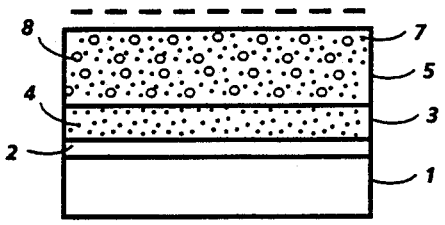
FIG. 4 is a partially schematic cross-sectional view of a negatively charged photoresponsive imaging member of the present invention.

Illustrated in FIG. 4 is a negatively charged photoresponsive imaging member of the present invention comprised of a substrate 1, an optional adhesive layer 2, a vacuum evaporated photogenerator layer 3 comprised of a fractionally sublimed indigoid pigment selected from the group consisting of those represented by the formulas of FIGS. 1, 2, or 3, and preferably 4,4',7,7'-tetrachlorothioindigo available from BASF as Paliogen Red L4982 (Pigment Red 88) optionally dispersed in a resinous binder composition 4, and a charge carrier hole transport layer 5 comprised of an aryl amine such as N,N'-diphenyl-N,N'-bis(3-methylphenyl)-[1,1'-biphenyl]-4,4'-diamine 7 dispersed in a polycarbonate resinous binder 8.

Figure 5:
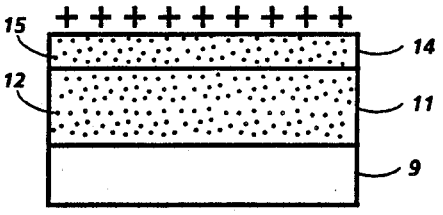
FIG. 5 is a partially schematic cross-sectional view of a positively charged photoresponsive imaging member of the present invention.

Illustrated in FIG. 5 is essentially the same member as shown in FIG. 1 with the exception that the hole transport layer is situated between the supporting substrate and the photogenerating layer. More specifically, with reference to this Figure, there is illustrated a positively charged photoconductive imaging member comprised of a supporting substrate 9, a hole transport layer 11 comprised of the aryl amine hole transport composition dispersed in an inactive resinous binder composition 12, and a photogenerating layer 14 comprised of an indigoid compound selected from the group consisting of those compounds represented by FIGS. 1, 2, and 3 optionally dispersed in a resinous binder composition 15.

Figure 6:
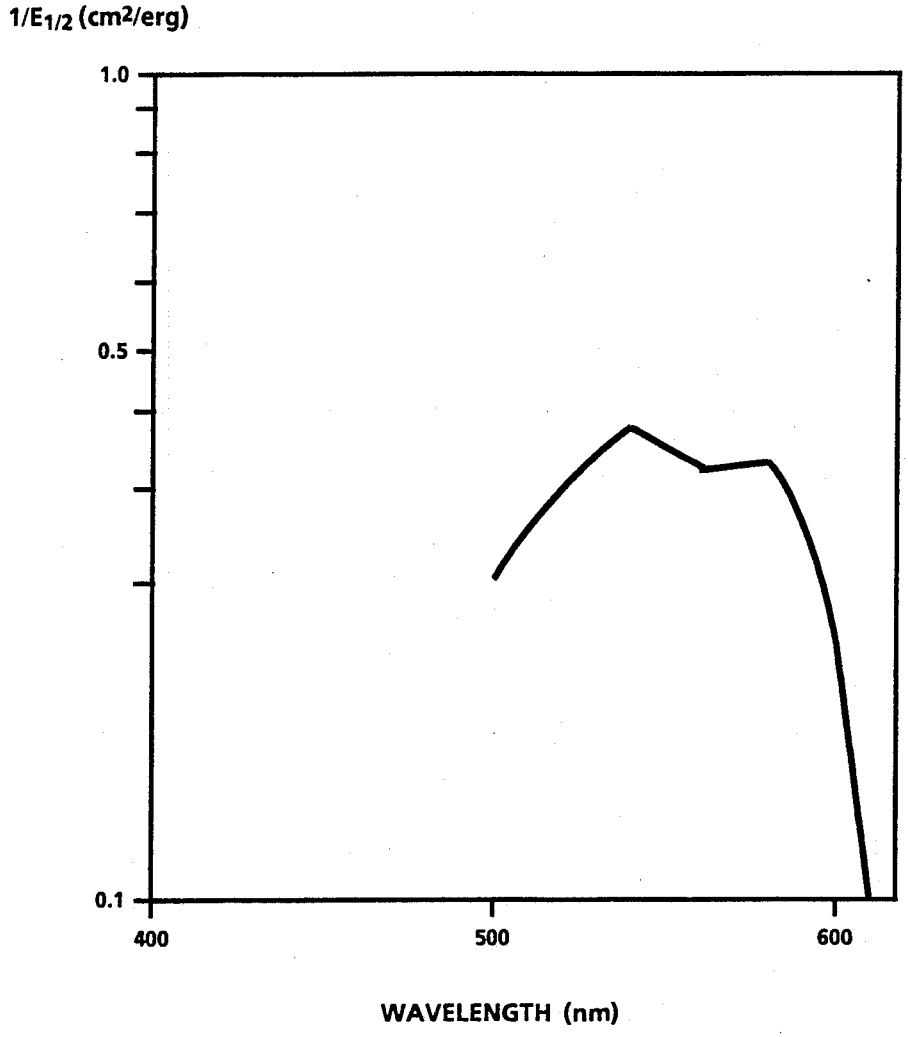
FIG. 6 is a line graph illustrating the spectral response of specific indigoid pigments of the present invention.

Illustrated in FIG. 6 is a plot of the $1/E_{\frac{1}{2}}$ value versus wavelength in nanometers for photoresponsive imaging members prepared in accordance with Example II.

Specifically, the curve represents the spectral response of the imaging member of Example II.

Figure 7:
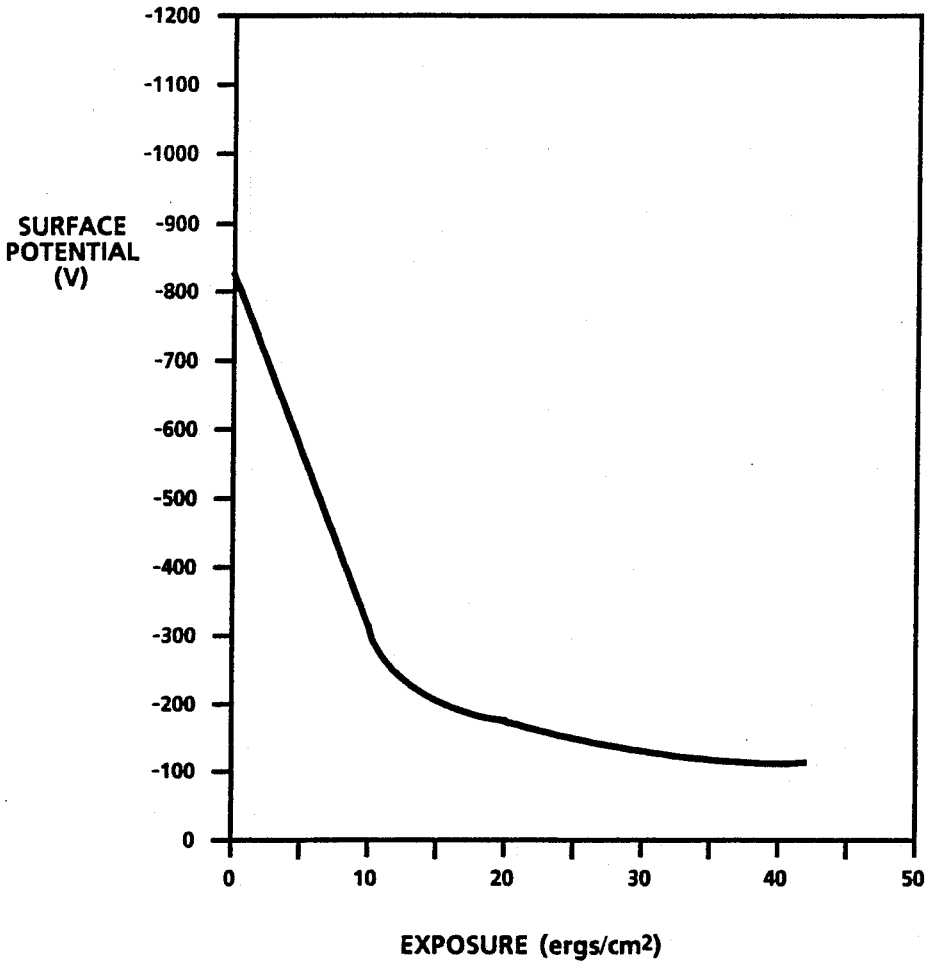
FIG. 7 is a photosensitivity line graph curve for specific imaging members of the present invention.

FIG. 7 illustrates the photosensitivity curve for the imaging member of Example II wherein the surface potential thereof is plotted against the light exposure energies recited.

Other photoconductive imaging members not specifically illustrated in FIGS. 4 and 5 are encompassed within the scope of the present invention including those wherein the indigoid compound is of the formula described in FIGS. 1 to 3 where X is O, S, NH, or Se and described in R is halogen, alkyl aryl, amino, alkoxy, nitro, cyano or hydrogen substituent.

With further reference to the imaging members of the present invention, the substrates may comprise a layer of insulating material such as an inorganic or organic polymeric material, including Mylar a commercially available polymer; a layer of an organic or inorganic material having a semiconductive surface layer such as indium tin oxide or aluminum arranged thereon, or a conductive material such as, for example, aluminum, chromium, nickel, titanium, brass, or the like. The substrate may be flexible or rigid and many have a number of many different configurations, such as for example, a plate, a cylindrical drum, a scroll, an endless flexible belt, and the like. Preferably, the substrate is in the form of an endless flexible belt. In some situations, it may be desirable to coat on the back of the substrate, particularly when the substrate is an organic polymeric material, an anti-curl layer, such as for example polycarbonate materials commercially available as Makrolon. The thickness of the substrate layer depends on many factors, including economical considerations, thus this layer may be of substantial thickness, for example over 100 mils, or of minimum thickness providing there are no adverse effects on the system. In one preferred embodiment, the thickness of this layer is from about 3 mils to about 10 mils.

The adhesive layers are typically comprised of a polymeric material including polyesters, poly(vinyl butyral), poly(vinyl pyrrolidone) and the like. Typically, this layer is of a thickness of less than about 0.1 micron. The imaging member of the present invention can include other layers therein as illustrated hereinbefore including metal oxide layers such as aluminum oxide and organo silanes, reference U.S. Pat. No. 4,450,450, the disclosure of which is totally incorporated herein by reference. Generally, the thickness of these layers is from about 0.5 to about 1 micron, however, other thicknesses can be selected providing the objectives of the present invention are achieved.

The photogenerating layers are generally of a thickness of from about 0.05 micron to about 10 microns, or more; and preferably is of a thickness of from about 0.1 micron to about 3 microns; however, the thickness of this layer is primarily dependent on the photogenerator weight loading which may vary from about 5 to 100 percent. Generally, it is desirable to provide this layer in a thickness which is sufficient to absorb about 90 percent or more of the incident radiation which is directed upon it, and the imagewise or printing exposure step. The maximum thickness of this layer is dependent primarily upon factors such as mechanical considerations, for example, whether a flexible photoconductive imaging member is desired, the thicknesses of the other layers, and the specific indigoid compound selected.

Various suitable aryl amine charge transport layers can be selected for the photoconductive imaging member of the present invention, which layer has a thickness of from about 5 microns to about 50 microns; and preferably is of a thickness of from about 10 microns to about 40 microns. In a preferred embodiment, this transport layer comprises aryl amine molecules of the following formula

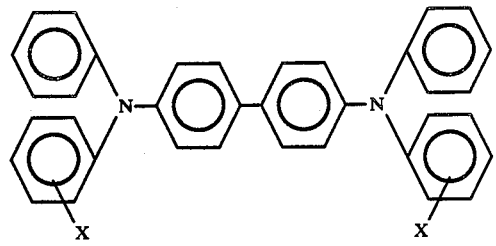

dispersed in a highly insulating and transparent organic resinous binder wherein X is selected from the group consisting of (ortho) $CH_3$, (meta) $CH_3$, (para) $CH_3$, (ortho) Cl, (meta) Cl, or (para) Cl.

Compounds corresponding to the above formula include, for example, N,N'-diphenyl-N,N'-bis(alkylphenyl)-[1,1-biphenyl]-4,4'-diamine wherein X is alkyl, or halogen, and preferably is selected from the group consisting of methyl such as 2-methyl, 3-methyl and 4-methyl, ethyl, propyl, butyl, hexyl, and the like. With halo substitution, the amine is N,N'-diphenyl-N,N'-bis(-halo phenyl)-[1,1'-biphenyl]-4,4'-diamine wherein halo is 2-chloro, 3-chloro or 4-chloro.

Examples of the highly insulating and transparent resinous material, or inactive binder resinous material for the transport layers include materials such as those described in U.S. Pat. No. 3,121,006, the disclosure of which is totally incorporated herein by reference. Specific examples of organic resinous materials include polycarbonates, acrylate polymers, vinyl polymers, cellulose polymers, polyester, polysiloxanes, polyamides, polyurethanes, and epoxies as well as block, random, or alternating copolymers thereof. Preferred electrically inactive binder materials are polycarbonate resins having a molecular weight (Mw) of from about 20,000 to about 100,000 with a molecular weight in the range of from about 50,000 to about 100,000 being particularly preferred. Generally, the resinous binder contains from about 10 to about 75 percent by weight of the active material corresponding to the foregoing formula, and preferably from about 35 percent to about 50 percent of this material.

Also included within the scope of the present invention are methods of imaging with the photoresponsive devices illustrated herein. These methods generally involve the formation of an electrostatic latent image on the imaging member, followed by developing the image with known developer compositions, reference for example U.S. Pat. Nos. 3,590,000; 4,469,770; 4,560,635 and 4,298,672, the disclosures of which are totally incorporated herein by reference; subsequently transferring the image to a suitable substrate, and permanently affixing the image thereto.

The invention will now be described in detail with reference to specific preferred embodiments thereof, it being understood that these examples are intended to be illustrative only. The invention is not intended to be limited to the materials, conditions, or process parameters recited herein. Also, all parts and percentages are by weight unless otherwise indicated.

EXAMPLE I

Purification of Paliogen Red-Violet L4982:

Two grams of Paliogen Red-Violet L4982 obtained from BASF were placed at about 5 inches from one end inside a pyrex tube (outer diameter 1 inch, length 28 inches). The tube was then placed inside a furnace comprised of a thick wall (0.5 inch thickness) copper tube wrapped with two electrical heater bands at one end and water cooling coils at the other end. A temperature gradient of from 450° to 25° C. was achieved along the length of the tube which was monitored by thermocouple probes. pyrex tube was positioned such that the indigoid to be sublimed was located within the heater bands. Thereafter, the indigoid was heated to about 450° C., and the vapors produced were swept toward the lower temperature end by a flow of low pressure (2 mbar) nitrogen carrier gas. Indigoid vapor was condensed to form a distinct violet deposit at a certain location where the temperature was between 300° and 270° C., whereas the more volatile impurities were deposited below 200° C., and thus separated from the purified indigoid. There remained a small amount of unsublimed residue where the Paliogen Red-Violet L4982 pigment was originally placed.

The purified indigoid, about 1.4 grams, was obtained in a yield of about 71 percent.

EXAMPLE II

Photoresponsive imaging members were prepared by providing a titanized Mylar substrate in a thickness of 75 microns with a layer of N-methyl-3-aminopropyl triethoxysilane and a DuPont 49,000 polyester adhesive layer thereon in a thickness of 0.05 micron, and depositing thereover with a Balzers vacuum coater a photogenerator layer of the indigoid of Example I at final thicknesses of 0.2, 0.4, 0.6 and 0.7 micron, respectively. A current of 25 amps was used to heat the photogenerator pigment in a tantalum boat and the vacuum coater evacuated to a pressure of about $10^{-5}$ Torr. Also, the substrate was mounted 16 centimeters from the boat, and the photogenerator layer was deposited at a rate of about 2 to 8 Angstroms/second.

Thereafter, the above photogenerating layers were overcoated with an amine charge transport layer prepared as follows:

A transport layer with 50 percent by weight Makrolon, a polycarbonate resin, was mixed with 50 percent by weight N,N'-diphenyl-N,N'-bis(3-methylphenyl)-1,1'-biphenyl-4,4'-diamine to 13 percent by weight in methylene chloride in an amber bottle. The resulting solution was then coated in a dry thickness of 25 microns on top of each of the above photogenerating layers using a multiple clearance film applicator. The resulting members were then dried in a forced air oven at 135° C. for 20 minutes.

The photosensitivity of these members was then determined by electrostatically charging the surface thereof with a corona discharge source until the surface potential, as measured by a capacitively coupled probe attached to an electrometer, attained an initial dark value $V_O$ of −810 volts. The front surface of the charged member was then exposed to light from a filtered 150 watt Xenon lamp allowing light in the wavelength range of 400 to 700 nanometers to reach the member surface. The exposure causing reduction of the surface potential to half of its initial value, $E_{\frac{1}{2}}$, and the percent discharge of surface potential due to various exposure energies was then determined. The photosensitivity can be determined in terms of the exposure in ergs/cm$^2$ necessary to discharge the member from the initial surface potential to half that value. The higher the photosensitivity, the smaller the exposure energy required to discharge the layer to 50 percent of the surface potential. The photosensitivity results are summarized in the following table.

| Thickness of Photogenerating Layer of Paliogen Red-Violet L4982 | $E_{\frac{1}{2}}$ ergs/cm$^2$ | % Discharge at 10 ergs/cm$^2$ |
|---|---|---|
| 0.2 micron | 13.0 | 40 |
| 0.4 micron | 10.7 | 48 |
| 0.6 micron | 8.7 | 55 |
| 0.7 micron | 8.2 | 59 |

The dark decay (loss in surface potential in the dark following charging) is less than 15 volts/second for each member.

The 0.7 micron member is more sensitive than the other members with thinner photogenerator layers. The photosensitivity results are illustrated in FIG. 4 where the surface potential is plotted against various exposure energies. Also, the cyclic stability over 1,000 imaging cycles in a xerographic imaging test fixture was excellent.

The characteristics of the imaging members of Example II indicate that such members can be selected for the generation of developed images of excellent quality with substantially no background deposits. These imaging members may be negatively charged, for example, when the photogenerating layer is situated between the hole transport layer and the supporting substrate, or positively charged when the hole transport layer is situated between the photogenerating layer and the substrate. With negatively charged imaging members, there is selected a positively charged developer composition, that is wherein the toner composition is positively charged and contains therein a charge enhancing additive such as distearyl dimethyl ammonium methyl sulfate, reference U.S. Pat. No. 4,560,635, the disclosure of which is totally incorporated herein by reference. When the imaging member is positively charged, there is selected a negatively charged developer composition comprised of resin particles such as styrene n-butyl methacrylate copolymers, and pigment particles such as carbon black, reference for example U.S. Pat. No. 4,469,770, the disclosure of which is totally incorporated herein by reference.

Other modifications of the present invention may occur to those skilled in the art subsequent to a review of the present application, and these modifications are intended to be included within the scope of the present invention.

What is claimed is:

1. An improved photoconductive imaging member comprised of a supporting substrate; a vacuum evaporated photogenerating layer comprised of fractionally sublimed indigoid compounds of the formulas of FIGS. 1, 2, or 3, wherein X is oxygen, sulfur, selenium or NH, and R is halogen, alkyl, amine, hydrogen, phenyl, alkoxy, nitro or cyano; and an aryl amine hole transport layer, wherein the fractionally sublimed indigoid compounds are obtained by subjecting them to a temperature of from about 200° to about 450° C. whereby impurities and deposition products more volatile than the desired components are separated at a temperature zone of below 200° C., and there is obtained purified indigoid components of a purity of at least about 95 percent at a temperature zone of from about 270° to about 300° C.

2. An imaging member in accordance with claim 1 wherein R is sulfur and the halogen is chlorine.

3. An imaging member in accordance with claim 1 wherein the indigoid is 4,4',7',7'-tetrachlorothioindigo.

4. An imaging member in accordance with claim 1 wherein the vacuum deposited photogenerating layer is situated between the supporting substrate and the hole transport layer.

5. An imaging member in accordance with claim 1 wherein the aryl amine hole transport layer is situated between the supporting substrate and the vacuum deposited photogenerating layer.

6. An imaging member in accordance with claim 1 wherein the supporting substrate is comprised of a conductive metallic substance, or an insulating polymeric composition overcoated with an electrically conductive layer.

7. An imaging member in accordance with claim 1 wherein the supporting substrate is aluminum, an organic polymeric composition, or a titanized Mylar.

8. An imaging member in accordance with claim 1 wherein the photogenerating compound is dispersed in a resinous binder in an amount of from about 5 percent by weight to about 95 percent by weight.

9. An imaging member in accordance with claim 8 wherein the resinous binder is a polyester, poly(vinyl butyral), a polycarbonate, poly(vinyl formal) or poly(-vinyl chloride).

10. An imaging member in accordance with claim 1 wherein the aryl diamine compound comprises molecules of the formula

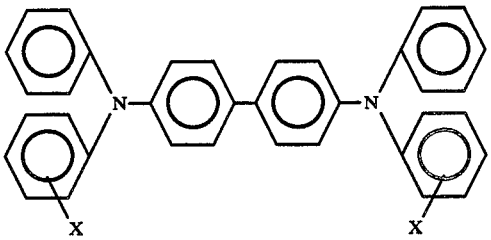

dispersed in a highly insulating and transparent organic resinous binder wherein X is selected from the group consisting of alkyl and halogen.

11. An improved imaging member in accordance with claim 10 wherein X is selected from the group consisting of ortho ($CH_3$), meta ($CH_3$), para ($CH_3$), ortho (Cl), meta (Cl), or para (Cl).

12. An imaging member comprised of (1) a supporting substrate; (2) a silane hole blocking layer; (3) a photogenerating layer comprised of the indigoid compounds of claim 1; and (4) an aryl amine hole transport layer.

13. An imaging member in accordance with claim 12 wherein there is included between the silane hole blocking layer and the vacuum deposited indigoid photogenerating layer an adhesive layer.

14. An imaging member in accordance with claim 13 wherein the adhesive layer is a polyester resin.

15. An imaging member in accordance with claim 12 wherein the aryl amine comprises molecules of the formula

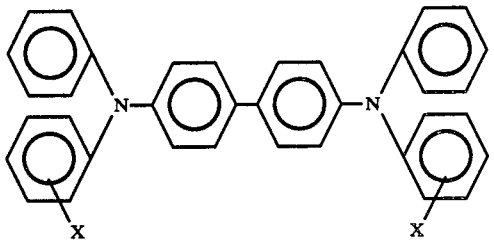

wherein X is selected from the group consisting of alkyl and halogen.

16. A method of imaging which comprises generating an electrostatic image on the imaging member of claim 1; developing the image formed; subsequently transferring this image to a suitable substrate; and thereafter permanently affixing the image thereto.

17. A method of imaging which comprises generating an electrostatic image on the imaging member of claim 12; developing the image formed; subsequently transferring this image to a suitable substrate; and thereafter permanently affixing the image thereto.

18. A method of imaging in accordance with claim 16 wherein the photogenerating layer is selected for the imaging member is 4,4',7',7'-tetrachlorothioindigo.

19. An imaging member in accordance with claim 18 containing a supporting substrate.

20. An imaging member in accordance with claim 18 wherein there is selected as the aryl amine hole transport layer a compound comprising molecules of the formula

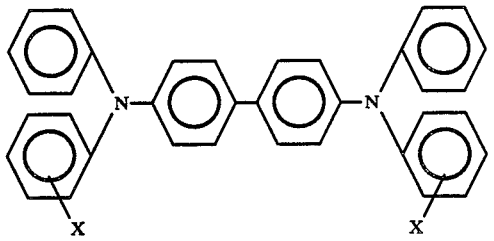

dispersed in a highly insulating and transparent organic resinous binder wherein X is selected from the group consisting of alkyl and halogen.

21. An imaging member in accordance with claim 18 wherein the indigoid is 4,4',7,7'-tetrachlorothioindigoid.

22. An improved photoconductive imaging member comprised of a supporting substrate; a photogenerator wherein the impurities thereof are removed by fractional sublimation and thereafter said purified photogenerating layer is applied to the supporting substrate, which photogenerating layer is comprised of the indigoid compounds of the formulas of FIGS. 1, 2 or 3 wherein X is oxygen, sulfur, selenium or NH, and R is halogen, alkyl, amine, hydrogen, phenyl, alkoxy, nitro or cyano; and an aryl amine hole transport layer; and wherein the fractional sublimation comprises subjecting the indigoid compounds to a temperature of from about 200° to about 450° C. whereby impurities and deposition products more volatile than the desired components are separated at a temperature zone of below 200° C., and there is obtained purified indigoid components of a purity of at least about 95 percent at a temperature zone of from about 270° to 300° C.

23. A photoconductive imaging member in accordance with claim 22 wherein the aryl amine comprises molecules of the formula

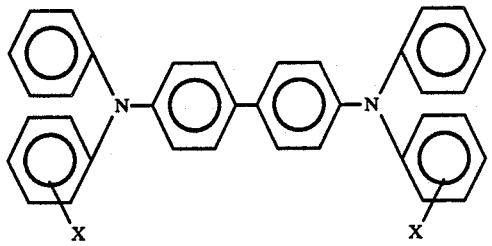

wherein X is selected from the group consisting of alkyl and halogen.

24. A photoconductive imaging member in accordance with claim 22 wherein the indigoid is 4,4',7,7'-tetrachlorothioindigo.

25. A photoconductive imaging member in accordance with claim 22 wherein the indigoid is Paliogen Red Violet.

26. A photoconductive imaging member in accordance with claim 22 wherein the photogenerating layer is of a thickness of from 0.2 micron to about 0.7 micron.

27. A photoconductive imaging member in accordance with claim 22 wherein the photogenerating layer is of a thickness of 0.7 micron.

28. A photoconductive imaging member in accordance with claim 22 comprising a silane hole blocking layer and an adhesive layer, which adhesive layer is situated between the hole blocking layer and the photogenerating layer.

29. A process for the preparation of photoconductive imaging members which comprises providing a supporting substrate; applying thereto a vacuum evaporated photogenerating layer of the indigoid compounds of FIGS. 1, 2 or 3 wherein X is oxygen, sulfur, selenium or NH, and R is halogen, alkyl, amine, hydrogen, phenyl, alkoxy, nitro or cyano; subsequent to the fractional sublimation thereof, which sublimation comprises subjecting the indigoid compounds to a temperature of from about 200° to about 450° C. whereby impurities and deposition products more volatile than the desired components are separated at a temperature zone of below 200° C., and there is obtained purified indigoid components of a purity of at least about 95 percent at a temperature zone of from about 270° to 300° C.; and thereafter applying to the photogenerating layer an aryl amine hole transport layer.

30. A process in accordance with claim 29 wherein the indigoid is 4,4',7,7'-tetrachlorothioindigo.

31. A process in accordance with claim 29 wherein the aryl amine hole transpor layer is comprised of molecules of the formula

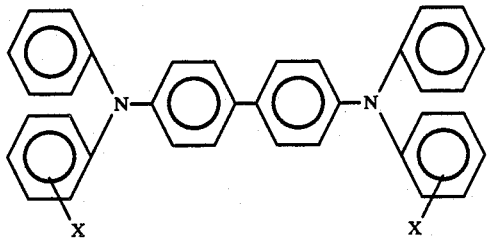

wherein X is selected from the group consisting of alkyl and halogen.

32. An imaging member in accordance with claim 1 wherein X is oxygen or selenium.

33. An imaging member in accordance with claim 22 wherein X is oxygen or selenium.

* * * * *